United States Patent [19]

Anderson, Jr.

[11] Patent Number: 4,932,671

[45] Date of Patent: Jun. 12, 1990

[54] FANTOM BLADED BROADHEAD

[75] Inventor: Howard P. Anderson, Jr., 14235 N. 20th Way, Phoenix, Ariz. 85022

[73] Assignee: Howard P. Anderson, Jr., Phoenix, Ariz.

[21] Appl. No.: 332,600

[22] Filed: Apr. 3, 1989

[51] Int. Cl.[5] ..... F41B 5/02

[52] U.S. Cl. ..... 273/421

[58] Field of Search ..... 273/421, 422, 419, 420

[56] References Cited

U.S. PATENT DOCUMENTS

| | | | |
|---|---|---|---|
| 2,568,417 | 9/1951 | Steinbacher | 273/421 |
| 2,859,970 | 11/1958 | Doonan | 273/421 |
| 2,993,697 | 7/1961 | Urban | 273/421 |
| 4,099,720 | 7/1978 | Zeren | 273/422 |
| 4,166,619 | 9/1979 | Bergmann et al. | 273/421 X |
| 4,341,391 | 7/1982 | Anderson | 273/422 |
| 4,452,460 | 6/1984 | Adams | 273/422 |
| 4,504,063 | 3/1985 | Lebus | 273/422 |

*Primary Examiner*—Paul E. Shapiro

[57] ABSTRACT

An expandable blade broadhead has a plurality of blades pivotally mounted on a circular ring. The ring is retained between a cap mounted on a stud extending from the front end of a ferrule, and the ferrule. A hardened steel tip is slidably mounted in a bore in the cap, and is formed with a rearwardly facing cam surface. The blades are normally held retracted in slots in the ferrule body and cap, and the tip is normally held is an extended position. When the broadhead impacts a target the tip is forced rearwardly forcing the cam surface against the blades pivoting them out of the slots to a rearwardly inclined position. To facilitate extraction the blades may pivot freely to a forwardly inclined position and the rear edges of the blades are sharpened.

1 Claim, 5 Drawing Sheets

FANTOM BLADED BROADHEAD

SUMMARY OF INVENTION

This invention relates to improvements in arrow heads.

A solid steel ring used to retain blades will allow the blades from a broadhead to stay retracted during flight, thereby eliminating wind resistance and planning caused by exposed blades, giving a more accurate flight. The plunger will allow the blades to expand, or open, upon impact, to give a maximum cutting edge and after penetration will allow blades to move forward relative to the arrow shaft, which will allow the broadhead to more easily remove itself from the target. By sharpening both sides of the blades will allow the broadhead to more effectively cut after impact as well as extract itself and eliminate any barbing effect.

A BRIEF DESCRIPTION OF THE DRAWINGS

FIG. 6 is a front plan view of the broadhead with the blades extended.

DETAILED DESCRIPTION OF THE PREFERRED EMBODIMENT

Figure 1:
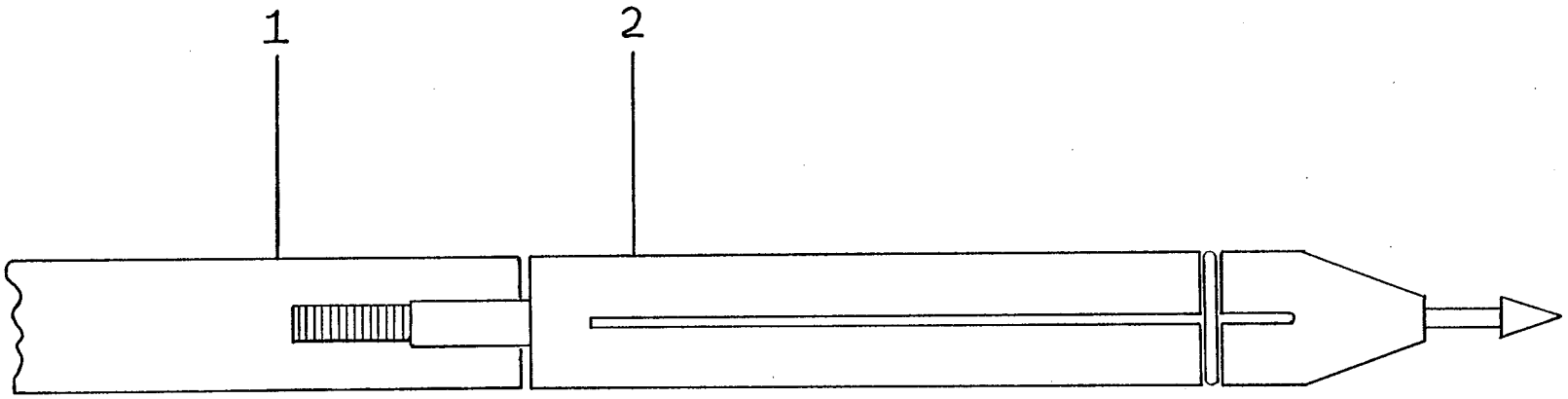
FIG. 1 is a side elevation view of a hunting broadhead. Embodying the invention and illustrated in the normal in flight operations and secured to an arrow shaft.
Figure 2:
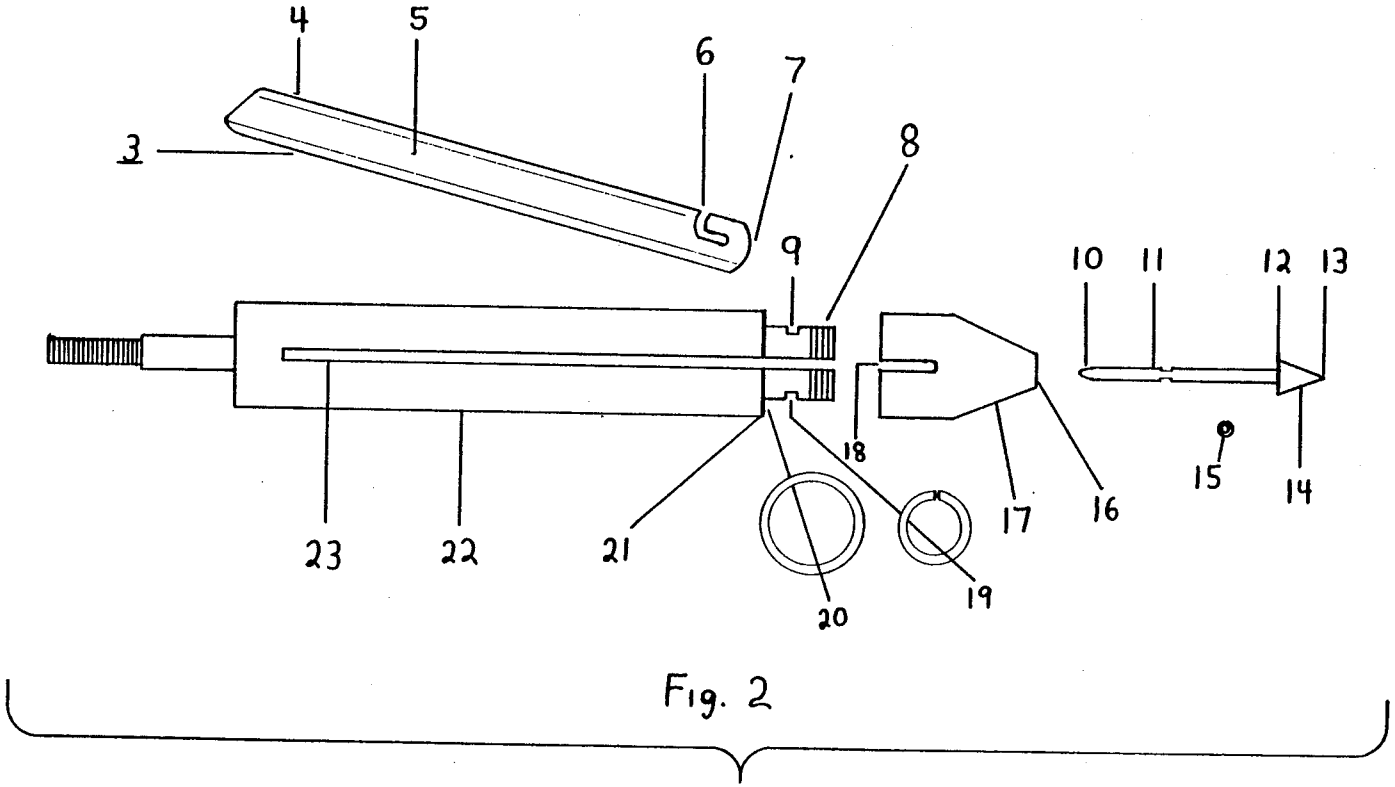
FIG. 2 is an exploded side elevation view of the arrow, shown in FIG. 2.
Figure 3:
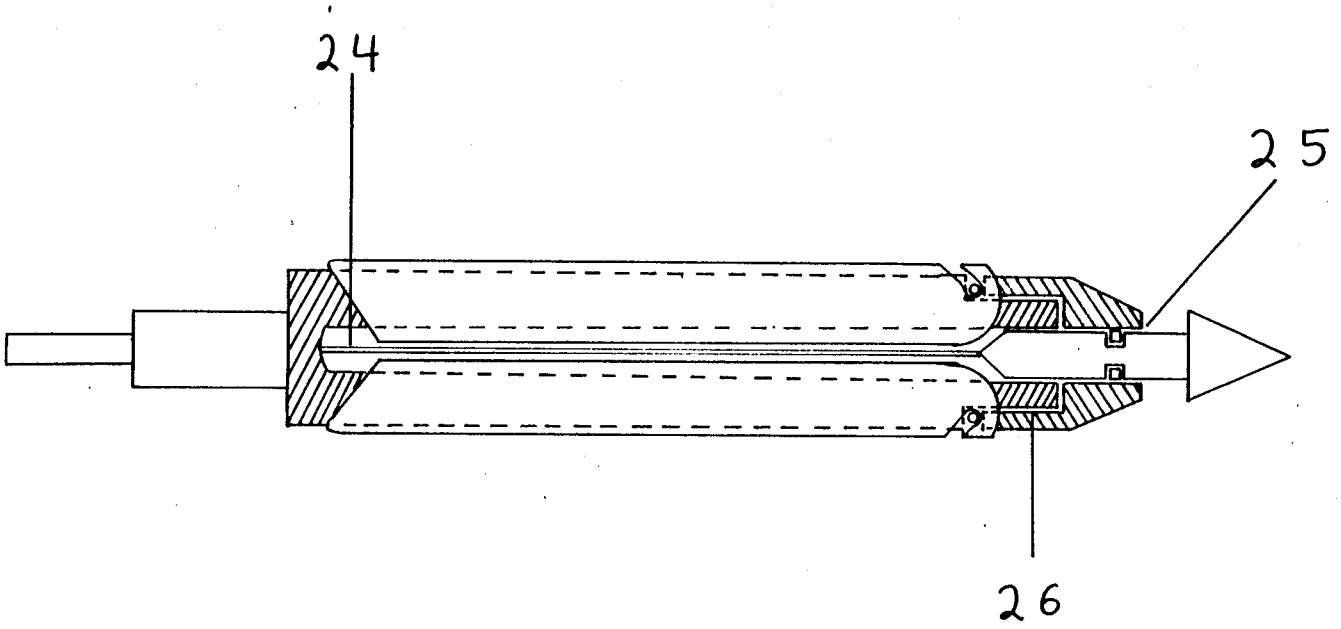
FIG. 3 is a sectional elevation view of a hunting broadhead arrow embodying the invention and illustrates the arrow in normal flight.
Figure 4:
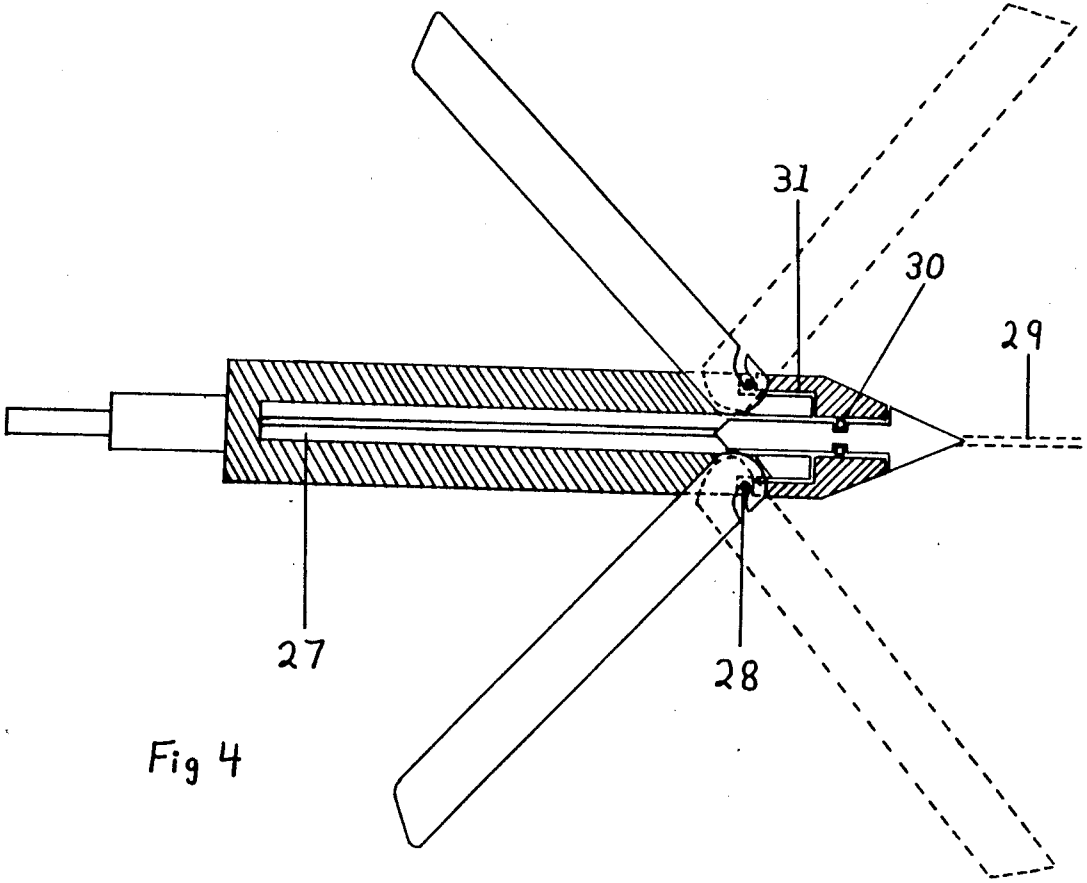
FIG. 4 is a sectional elevation view of a hunting broadhead arrow embodying the invention and illustrates the extended impact position of the blades.
Figure 5:
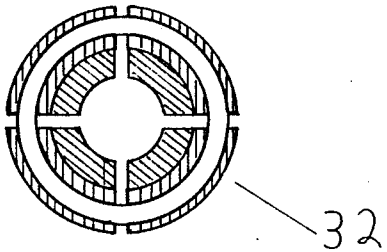
FIG. 5 is a front plan view of the broadhead with the blades retracted.

Referring to the drawing in detail; reference character 2 generally indicates a hunting broadhead adapted to be secured to one end of an arrow shaft 1 in a manner, as herein after set forth.

The arrow head 2, comprised of a hollow body 24 having a plurality of circumferentially spaced longitudinally extending slots 23 provided, or the outer periphery thereof, and extending through the sidewall thereof. A blade member 5 substantially straight, has an inner sharpened edge 3 an outer sharpened edge 4, a blade 5 which will fit inside the slot 23 and held onto steal ring 20, which will lay on the lip of the shaft 21. The blade will be rounded on top 7 to allow blade members to rapidly extend outward from the outer periphery of the ferrule 22 when pushed by the plunger 11.

The blade members 5 are substantially flat in construction, with the outer edge 4 sharp, and the inner edge 3 sharp for cutting. The top 7 is rounded to allow for a smooth movement when pushed by the plunger 11. The blade 5 is also notched on the top outer edge 6 thereby allowing blades 5 to hook onto ring 20.

A diameter reduction 8 is provided around the top portion of the ferrule, or neck, 22 for receiving a solid ring 20, which will hold the blades 5. The reduced portion 8 of the ferrule 22 is then annular recessed 9 to provide for a snap ring 19, which will cause friction engagement with the cap 17, which will fit over the reduced diameter of the ferrule 8 and over the snap ring 19 and sit on top of the solid ring 20, which will also sit over the reduced diameter of the ferrule 22 and over the snap ring 19 to sit flush on the ledge 28 of the ferrule.

The cap 17 will be comprised of a hollow body 16 with circumferentially spaced and longtitudinal slots 18 half way extending through the side wall. This is done to allow the neck 8 to receive the cap 17, which will be will be threaded as seen 26.

The plunger 11 which will, on impact, be pushed inward, thereby engaging with the blades 5 at the point of the top 7 and pivoting them outwardly from the center of the ferrule 22.

The bottom, or rounded part of the plunger 11, will be tapered to fit smoothly against the tops 7 of the blades 5. The shaft of the plunger 11 will be fitted with a teflon ring 15, which will allow the plunger to sit snugly within the top half of the cap 17. The top of the plunger 14 will be wide at the base 12 and sharpened at the tip 13. After impact, the base will stop the plunger when it reaches the cap 17 and the plunger shaft 11 will keep the blades from returning to a closed position.

What is claimed is:

1. A hunting broadhead comprising:

(a) a cylindrical ferrule body of a first diameter said body having means at one end for mounting said body to an arrow shaft and a reduced diameter neck extending forwardly from the other end of said body and defining at its junction with said body a circular shoulder, (b) a diametrical slot in said body extending from the forward end of said neck rearwardly into said body, (c) a pair of elongated blades having cutting edges on both long sides positioned in said slot in a retracted position, with the forward ends of said blades positioned forwardly of said shoulder, the forward ends of said blades each having a radially inwardly and rearwardly inclined leading edge, (d) a ring positioned on said shoulder about said neck and extending through the forward ends of said blades radially outwardly of said inclined edges whereby said blades may pivot about said ring both forwardly and rearwardly of said ring, (e) a cap having an internal bore positioned over and secured to said neck to hold said ring against said shoulder, said cap having a pair of slots aligned with said diametrical slot, (f) a central bore extending through said cap and neck and into said body along the longitudinal central axis thereof, (g) a plunger having a leading penetrating top and a rearwardly extending shaft of reduced lateral dimension relative to said top, said shaft having a tapered rear end, said shaft being slidably positioned in said bore with said tapered rear end normally in contact with or ahead of the leading edges of said blades, (h) wereby, when said broadhead is in flight said blades are normally in said retracted position thus reducing wind resistance and planeing and upon impact said plunger is driven rearwardly in said bore and the tapered rear end of said shaft pushes against the inclined leading edges of said blades to pivot said blades outwardly of said slot to a rearwardly inclined position with the rear end behind the ring to increase cutting width of said broadhead, and said blades may pivot to a forwardly directed position with the rear end of the blades in front of the ring upon rearward extraction.

* * * * *